US007222931B2

(12) United States Patent
Lee

(10) Patent No.: US 7,222,931 B2
(45) Date of Patent: May 29, 2007

(54) METHOD AND APPARATUS FOR CORRECTING PRINTING ERROR

(75) Inventor: Yong-duk Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 202 days.

(21) Appl. No.: 10/758,128

(22) Filed: Jan. 16, 2004

(65) Prior Publication Data

US 2004/0150686 A1 Aug. 5, 2004

(30) Foreign Application Priority Data

Jan. 18, 2003 (KR) ..... 10-2003-0003470

(51) Int. Cl.
*B41J 29/38* (2006.01)
*B41J 29/393* (2006.01)

(52) U.S. Cl. ..... 347/16; 347/19

(58) Field of Classification Search ..... 347/16, 347/19

See application file for complete search history.

(56) References Cited

U.S. PATENT DOCUMENTS 6,076,915 A * 6/2000 Gast et al. ..... 347/19
6,390,698 B1 * 5/2002 Yoshida et al. ..... 400/356
2002/0070998 A1 * 6/2002 Bloomberg ..... 347/41

* cited by examiner

*Primary Examiner*—Stephen Meier
*Assistant Examiner*—Rene Garcia, Jr.
(74) *Attorney, Agent, or Firm*—Staas & Halsey LLP

(57) ABSTRACT

A method for correcting a printing error in an inkjet printer having a printer head on which the $1^{st}$ through $2N^{th}$ nozzles are provided, in which N is a positive integer greater than 0, and a feed roller, the method including: determining whether a trailing end of a print paper has escaped from the feed roller which periodically moves the print paper the width of the printer head; if the trailing end of the print paper is determined to have escaped from the feed roller, moving the print paper half the width of the printer head and printing a reference line by ejecting ink at a predetermined interval using a $k^{th}$ nozzle ($1 \leqq k \leqq N$) among the $1^{st}$ though $N^{th}$ nozzles disposed above the print paper; moving the print paper on which the reference line is printed half the width of the printer head and printing comparison lines by ejecting ink at a predetermined interval using the $(N+1)^{th}$ through $2N^{th}$ nozzles disposed above the print paper; detecting an error distance between the reference line and the comparison line printed by the $l^{th}$ nozzle ($N+1 \leqq l \leqq 2N$) disposed at a position corresponding to the $k^{th}$ nozzle among the $(N+1)^{th}$ through $2N^{th}$ nozzles; and correcting a distance that the print paper moved according to the detected error distance.

40 Claims, 9 Drawing Sheets

METHOD AND APPARATUS FOR CORRECTING PRINTING ERROR

CROSS-REFERENCE TO RELATED APPLICATIONS

This application claims the benefit of Korean Patent Application No. 2003-3470, filed on Jan. 18, 2003, in the Korean Intellectual Property Office, the disclosure of which is incorporated herein in its entirety by reference.

BACKGROUND OF THE INVENTION

1. Field of the Invention

The present invention relates to the correction of a printing error in an inkjet printer, and more particularly, to a method and apparatus to correct printing errors relating to improper paper movement caused by a feed roller.

2. Description of the Related Art

In general, inkjet printers print various materials that are displayed on computer monitors on print paper according to electric signals received from a computer. Generally, inkjet printers have a pickup roller, a feed roller, one or more printer heads, and an exhaust roller. During the printing process of an inkjet printer, print paper contained in a paper cassette is supplied by a pickup roller to the feed roller one sheet at a time. The print paper supplied to the feed roller is supplied to the printer head by the constant-speed driving of the feed roller. The printer head then prints on the supplied print paper. After printing, the paper is output from the inkjet printer by the exhaust roller.

However, when a trailing end of a sheet of print paper passes the feed roller while being moved toward the printer head, print quality can be lowered due to the excessive movement of the paper. In other words, when the feed roller rotates by a predetermined distance a, the print paper is exhausted by the distance a as well. When the trailing end of the print paper passes the feed roller, the print paper exhausted by the distance a is further exhausted by a distance "$a+\alpha=L$" by the feed roller and the exhaust roller so as to be excessively exhausted by a distance $\alpha$. Thus, a blank area the length of $\alpha$ can be generated on the print paper. Since there is a drag force present that corresponds to the force of the feed roller pulling the print paper, and the pulling force disappears when the print paper escapes from the feed roller, the print paper is overly exhausted by the distance $\alpha$. Also, the height of the trailing end of the print paper changes when the trailing end of the print paper passes the feed roller. The printer head ejects ink onto a portion of the paper where the ink is already ejected so that an undesirable print state is generated. Thus, when the trailing end of the print paper passes the feed roller, the above problems can occur.

SUMMARY OF THE INVENTION

To solve the above and/or other problems, the present invention provides a method of detecting potential and/or actual errors resulting from the distance moved by print paper, and altering the driving of the feed roller to correct and/or prevent the errors.

Also, the present invention provides an apparatus for detecting an error with respect to a distance moved by a print paper so that the error is reflected in the driving of a feed roller.

According to an aspect of the present invention, a method is provided for correcting a printing error occurring in an inkjet printer comprising a printer head on which $1^{st}$ through $2N^{th}$ nozzles are provided, in which N is a positive integer greater than 0, and a feed rollerThe method comprises: determining whether a trailing end of a sheet of print paper has escaped from the feed roller by periodically moving the print paper the width of the printer head; if the trailing end of the sheet of print paper is determined to have escaped from the feed roller, moving the print paper half of the width of the printer head and printing a reference line by ejecting ink at a predetermined interval using a $k^{th}$ nozzle ($1 \leqq k \leqq N$) from among the $1^{st}$ though $N^{th}$ nozzles disposed above the print paper; moving the print paper on which the reference line is printed half the width of the printer head; and printing comparison lines by ejecting ink at a predetermined interval using the $(N+1)^{th}$ through $2N^{th}$ nozzles disposed above the print paper detecting an error distance between the reference line and the comparison line printed by the $l^{th}$ nozzle ($N+1 \leqq l \leqq 2N$) disposed at a position corresponding to the $k^{th}$ nozzle among the $(N+1)^{th}$ through $2N^{th}$ nozzles; and correcting the distance that the print paper is moved according to the detected error distance.

According to another aspect of the present invention, an apparatus is provided to correct a printing error occurring in an inkjet printer having a printer head on which the $1^{st}$ through $2N^{th}$ nozzles are provided, in which N is a positive integer greater than 0, and a feed roller. The apparatus comprises: a print paper escape detector to detect whether a trailing end of a sheet of print paper has escaped from the feed roller by periodically moving the print paper the width of the printer head, and outputting the result of the detection as a first control signal; a feed roller driving controller to output a second control signal to move the print paper half the width of the printer head in response to the first control signal, a fourth control signal to move the print paper half of the width of the printer head in response to a third control signal, and a seventh control signal to move the print paper by a corrected distance in response to a sixth control signal; a printer head ejection controller to output the third control signal and print a reference line using a $k^{th}$ nozzle ($1 \leqq k \leqq N$) from among the $1^{st}$ through $N^{th}$ nozzles disposed above the print paper in response to the second control signal, and a fifth control signal to print comparison lines using the $(N+1)^{th}$ through $2N^{th}$ nozzles disposed above the print paper in response to the fourth control signal; and an error distance detector to detect an error distance between the reference line and the comparison line printed by the $l^{th}$ nozzle ($N+1 \leqq l \leqq 2N$) disposed at a position corresponding to the $k^{th}$ nozzle among the $(N+1)^{th}$ through $2N^{th}$ nozzles in response to the fifth control signal and outputting the result of the detection as the sixth control signal.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments taken in conjunction with the accompanying drawings in which.

DETAILED DESCRIPTION OF THE PREFERRED EMBODIMENTS

Figure 1:
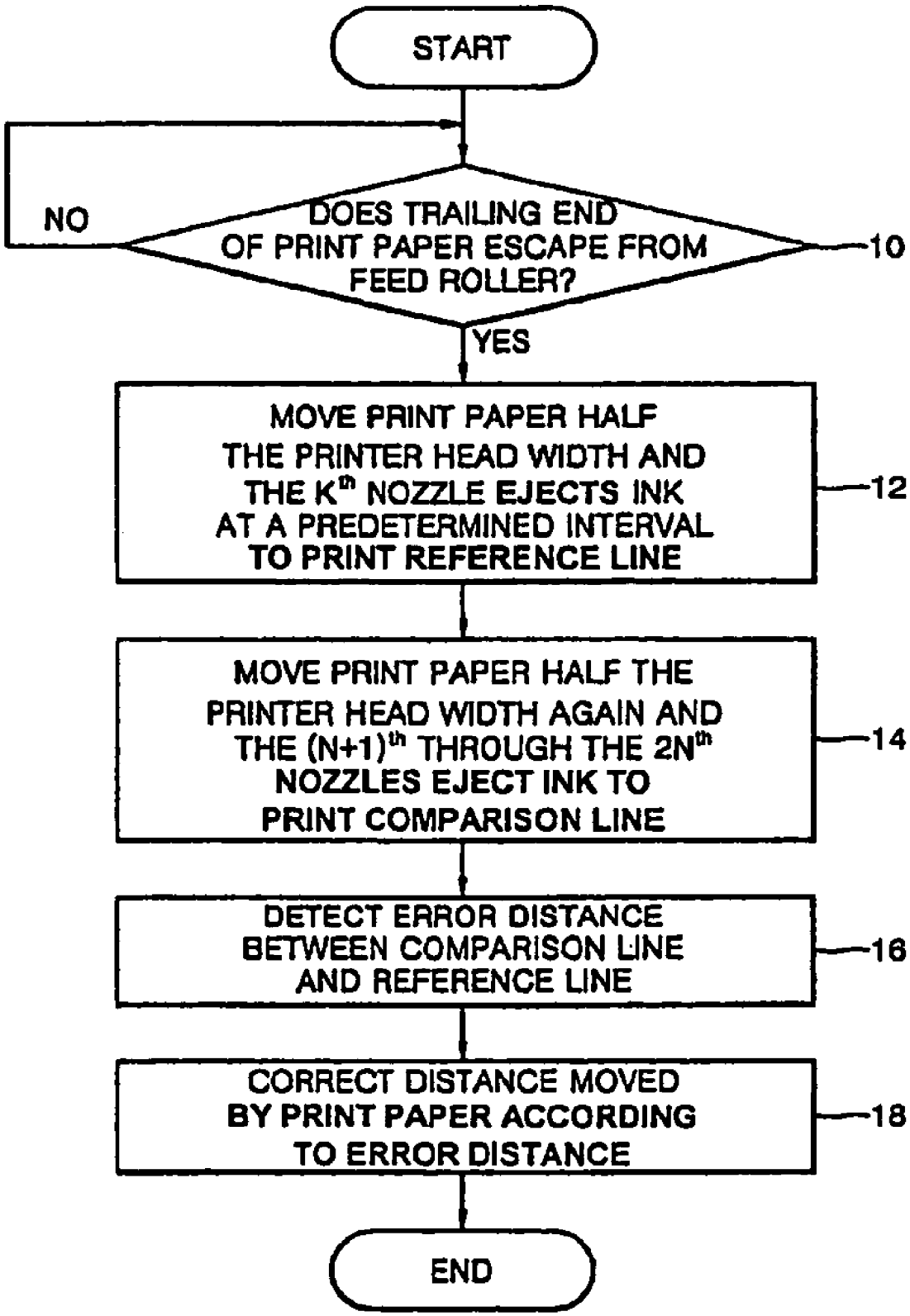
FIG. 1 is a flow chart showing a method of correcting a printing error according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Referring to FIG. 1, a method of correcting a printing error according to an embodiment of the present invention includes printing a reference line and a comparison line by moving a sheet of print paper that has escaped from a feed roller half of the width of the printer head and correcting the distance that the print paper moves by detecting an error distance using the printed reference line and comparison line (operations 10–18).

Figure 2:
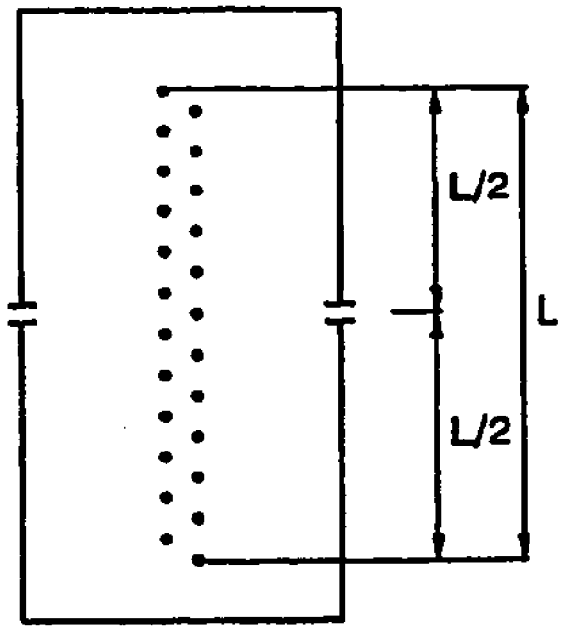
FIG. 2 is a view illustrating the width of a printer head.

First, it is determined if the trailing end of a sheet of print paper has escaped from the feed roller which periodically moves the print paper the width of a printer head (operation 10). The width of a printer head refers to a width of the $1^{st}$ through $2N^{th}$ nozzles provided on the printer head. N is a positive integer greater than 0. That is, the width of the printer head refers to the sum of the distances between neighboring nozzles. FIG. 2 shows the width of a printer head. A distance L between the $1^{st}$ through $2N^{th}$ nozzles provided at the printer head shown in FIG. 2 is the width of the printer head. The determination is continuously made until the trailing end of a sheet of print paper is determined to have escaped from the feed roller.

Figure 3A:
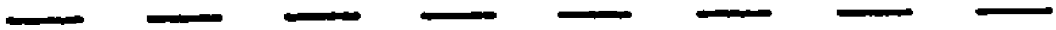
FIGS. 3A and 3B are views illustrating the reference line and the reference point printed on the print paper by the $k^{th}$ nozzle, respectively.
Figure 3B:
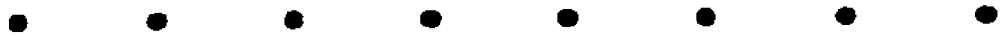

If the trailing end of the sheet of print paper is determined to have escaped from the feed roller, the print paper is moved half the width of the printer head (L/2) and the $k^{th}$ nozzle ($1 \leqq k \leqq N$), which is among the $1^{st}$ through $N^{th}$ nozzles located above the print paper ejects ink at a predetermined interval to print a reference line (operation 12). FIG. 2 show that distance of L/2 corresponds to half the width of the printer head. The reference line is a series of lines printed along a straight line by a single nozzle. The reference point is a series of points printed along a straight line by a single nozzle. FIGS. 3A and 3B show a reference line and a reference point printed on the print paper by the $k^{th}$ nozzle, respectively. FIG. 3A shows a state in which the series of reference lines is printed along a straight line by the $k^{th}$ nozzle. The reference line and the reference point are printed at a predetermined interval along a straight line. FIG. 3B shows a state in which the reference point is printed on a straight line by the $k^{th}$ nozzle.

After operation 12, the print paper on which the reference line is printed is again moved half the width of the printer head (L2) and the $(N+1)^{th}$ through $2N^{th}$ nozzles eject ink at a predetermined interval to print comparison lines (operation 14). The $(N+1)^{th}$ through $2N^{th}$ nozzles located above the print paper eject ink at a predetermined interval to print the comparison lines printed in operation 14. The comparison lines are printed by the $(N+1)^{th}$ through $2N^{th}$ nozzles. To detect an error distance, the comparison lines are compared with the reference line. The predetermined interval at which the comparison lines are printed is the same as the predetermined interval at which the reference line is printed.

After operation 14, an error distance between the reference line and the comparison line, printed by the $l^{th}$ nozzle ($N+1 \leqq l \leqq 2N$) disposed at a position corresponding to the $k^{th}$ nozzle from among the $(N+1)^{th}$ through $2N^{th}$ nozzles, is detected (operation 16). The $l^{th}$ nozzle, one of the $(N+1)^{th}$ through $2N^{th}$ nozzles, is disposed among the $(N+1)^{th}$ through $2N^{th}$ nozzles corresponding to a position identical to the position of the $k^{th}$ nozzle of the $1^{st}$ through the $N^{th}$ nozzles.

Figure 4:
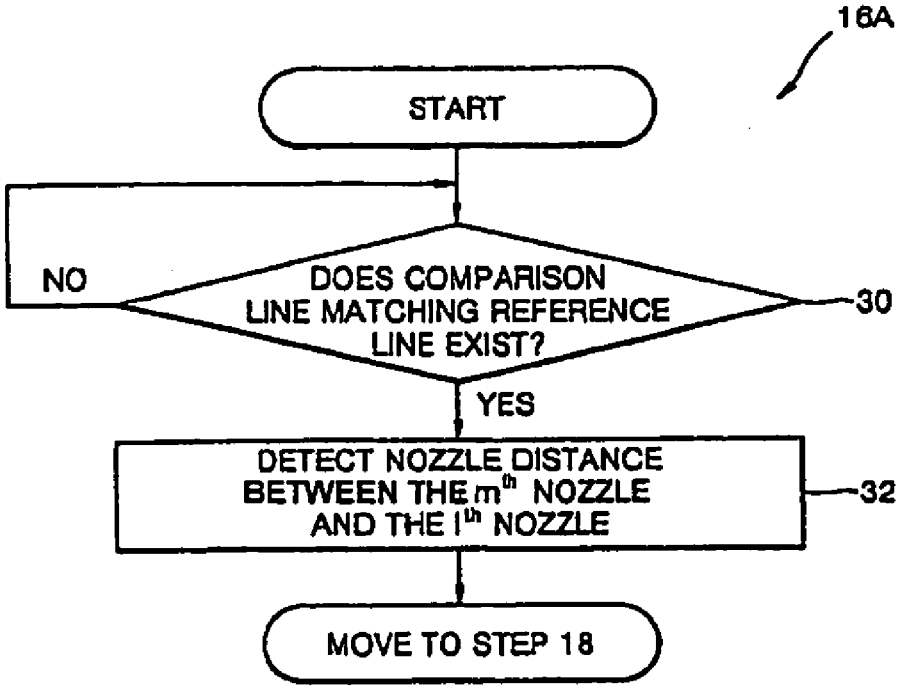
FIG. 4 is a flow chart showing an aspect of operation 16 shown in FIG. 1.

FIG. 4 is a flow chart explaining an aspect 16A of the present invention with respect to operation 16 shown in FIG. 1. This aspect comprises determining whether a comparison line matching a predetermined comparison line exists and calculating a nozzle distance (operations 30 and 32).

First, it is determined if the predetermined comparison line matching the reference line exists (operation 30). The predetermined comparison line matching the reference line is a comparison line printed in operation 14 that is printed on the same position as the reference line printed in operation 12. The determination is continuously made until a predetermined comparison line matching the reference line is determined to exist.

Figure 5A:
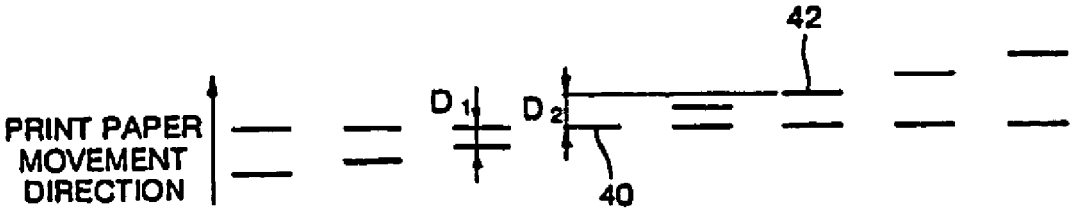
FIGS. 5A and 5B are views illustrating the states in which a reference line and a comparison line are printed or a reference point and a comparison point are printed, respectively.
Figure 5B:
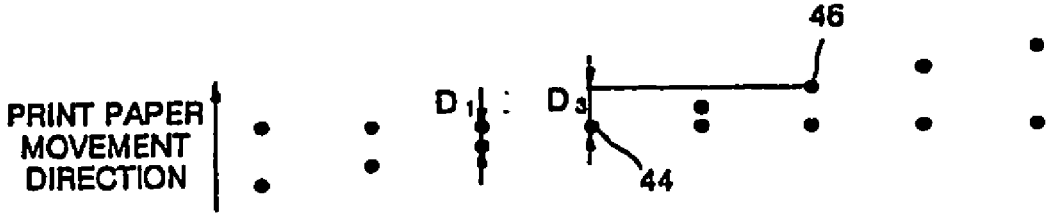

If the predetermined comparison line matching the reference line is determined to exist, a nozzle distance between the $l^{th}$ nozzle and the $m^{th}$ nozzle ($N+1 \leqq m \leqq 2N$), the $m^{th}$ nozzle having printed the predetermined comparison line matching the reference line, is calculated and an error distance is detected using the calculated nozzle distance (operation 32). FIGS. 5A and 5B are views illustrating the states in which the reference line and the comparison line are printed or the reference point and the comparison point are printed, respectively.

Referring to FIG. 5A, the $m^{th}$ nozzle prints a predetermined comparison line 40 matching the reference line. This comparison line 40 is detected, and distance from a comparison line 42, printed by the $l^{th}$ nozzle which is disposed at a position corresponding to the $k^{th}$ nozzle, is calculated. This distance is the nozzle distance between the $m^{th}$ nozzle and the $l^{th}$ nozzle. When the feed roller actually moves the print paper half the width of the printer head, the $l^{th}$ nozzle and the $m^{th}$ nozzle are the same nozzle. However, as previously noted as a problem in the conventional technology, since the feed roller does not accurately move the print paper half the width of the printer head, a difference is present between the $l^{th}$ nozzle and the $m^{th}$ nozzle. The respective comparison lines are printed a certain distance from the reference line. This distance is a multiple of the neighboring nozzle distance D1. Thus, as shown in FIG. 5A, the distance between the $l^{th}$ nozzle and the $m^{th}$ nozzle corresponds to 2×D1 which is the error distance D2. If the feed roller accurately moves the print paper, the comparison line 42 printed by the $l^{th}$ nozzle will match the reference line printed by the $k^{th}$ nozzle. However, as shown in FIG. 5A, the further the print paper moves, the greater the error distance D2, and the greater the error distance in printing.

Referring to FIG. 5B, the comparison point 44, printed by the $m^{th}$ nozzle, matching the reference point is detected. The distance from the comparison point 46, printed by $l^{th}$ nozzle that is disposed at a position corresponding to the $k^{th}$ nozzle, is calculated as shown in FIG. 5A. The calculated distance is an error distance D3.

After operation 16, the distance that the print paper moves is corrected according to the detected error distance (operation 18). For example, when the error distance is D2 or D3, an error distance in printing is generated as the print paper moves the error distance D2 or D3, and the driving of the feed roller is corrected not to move the print paper the error distance D2 or D3.

Figure 6:
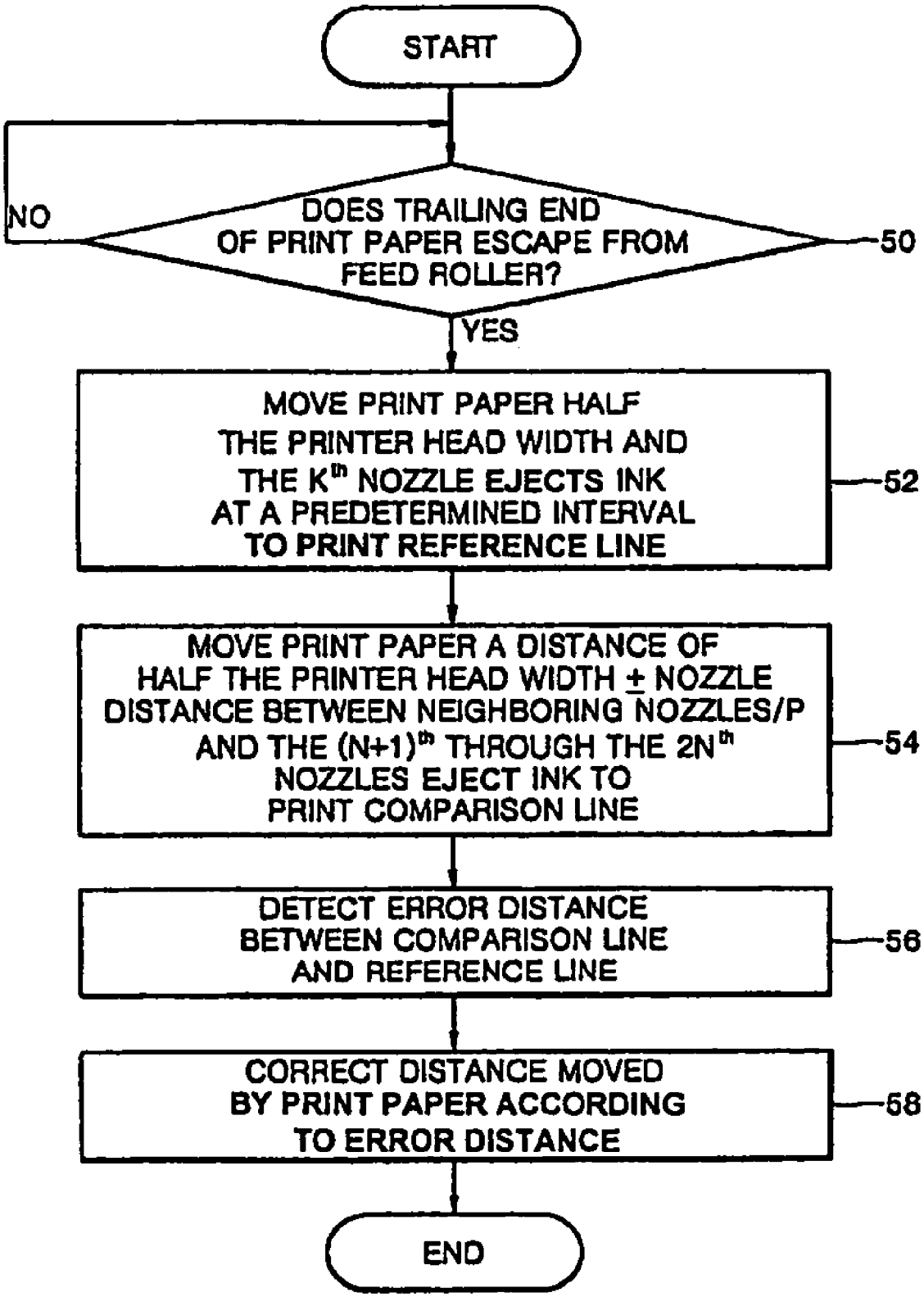
FIG. 6 is a flow chart showing a method of correcting a printing error according to another aspect of the present invention.

FIG. 6 is a flow chart showing a method of correcting a print error according to another aspect of the present invention. The method of correcting a print error according to another aspect of the present invention comprises: printing a reference line by moving a print paper that has escaped from the feed roller half the width of the printer head; printing a comparison line by moving the print paper half the width of the printer head±a nozzle distance between neighboring nozzles divided by p, in which p is a positive integer greater than 0; and correcting the distance that the print paper moves by detecting the error distance between the printed reference line and the comparison line (operations 50–58).

First, it is determined if the trailing end of a sheet of print paper has escaped from the feed roller which periodically moves the print paper the width of the printer head (operation 50). The width of the printer head is the widths of the $1^{st}$ through $2N^{th}$ nozzles of the printer head, in which N is a positive integer greater than 0. That is, the width of the printer head is the total of the distances between neighboring nozzles, for example, the width L between the first through $2N^{th}$ nozzles provided at the printer head shown in FIG. 2. The determination is continuously made until the trailing end of a sheet of print paper is determined to have escaped from the feed roller.

If the trailing end of a sheet of the print paper is determined to have escaped from the feed roller, the print paper is moved half the width of the printer head and the $k^{th}$ nozzle ($1 \leqq k \leqq N$), one of the $1^{st}$ through $N^{th}$ nozzles located above the print paper, ejects ink at a predetermined interval to print a reference line (operation 52). For example, the print paper is moved a distance L/2 that corresponds to half the width of the printer head shown in FIG. 2. The reference line is a series of lines printed along a straight line by a single nozzle. The reference point is a series of points printed along a straight line by a single nozzle. FIGS. 3A and 3B show the reference line and the reference point printed on the print paper by the $k^{th}$ nozzle, respectively. Since FIGS. 3A and 3B are already described above, detailed descriptions thereof will be omitted.

After operation 52, the print paper on which the reference line is printed is moved half the width of the printer head±a nozzle distance between neighboring nozzles divided by p, in which p is a positive integer greater than 0. The $(N+1)^{th}$ through $2N^{th}$ nozzles located above the print paper eject ink at a predetermined interval to print comparison lines (operation 54). The nozzle distance between the neighboring nozzles divided by p is a value set to finely adjust the distance the print paper is to be moved, so that the print paper is moved by a distance that is more than or less than the value obtained by dividing the nozzle distance between the neighboring nozzles by p. Here, p is a positive integer by which the nozzle distance between the neighboring nozzles is divided. The resulting distance that the print paper is to be moved is the distance plus or minus half the width of the printer head. For example, when the printer head width is L/2 as shown in FIG. 2, the nozzle distance between the neighboring nozzles is D1 as shown in FIG. 5A, and p is 3, the print paper is moved L/2±D1/3.

The comparison lines are printed on the reference line that is printed in operation 52 as the $(N+1)^{th}$ through $2N^{th}$ nozzles eject ink at a predetermined interval. The comparison lines are printed by the $(N+1)^{th}$ through $2N^{th}$ nozzles to detect an error distance that is to be compared with the reference line. The predetermined interval at which the comparison lines are printed is the same as the predetermined interval of the reference line.

After operation 54, an error distance between the reference line and the comparison line printed by the $l^{th}$ nozzle ($N+1 \leqq l \leqq 2N$), the $l^{th}$ nozzle being disposed at a position corresponding to the $k^{th}$ nozzle among the $(N+1)^{th}$ through $2N^{th}$ nozzles, is detected (operation 56). The $l^{th}$ nozzle is one of the $(N+1)^{th}$ through $2N^{th}$ nozzles, and is disposed among the $(N+1)^{th}$ through $2N^{th}$ nozzles corresponding to a position identical to the position of the $k^{th}$ nozzle of the $1^{st}$ through the $N^{th}$ nozzles.

Figure 7:
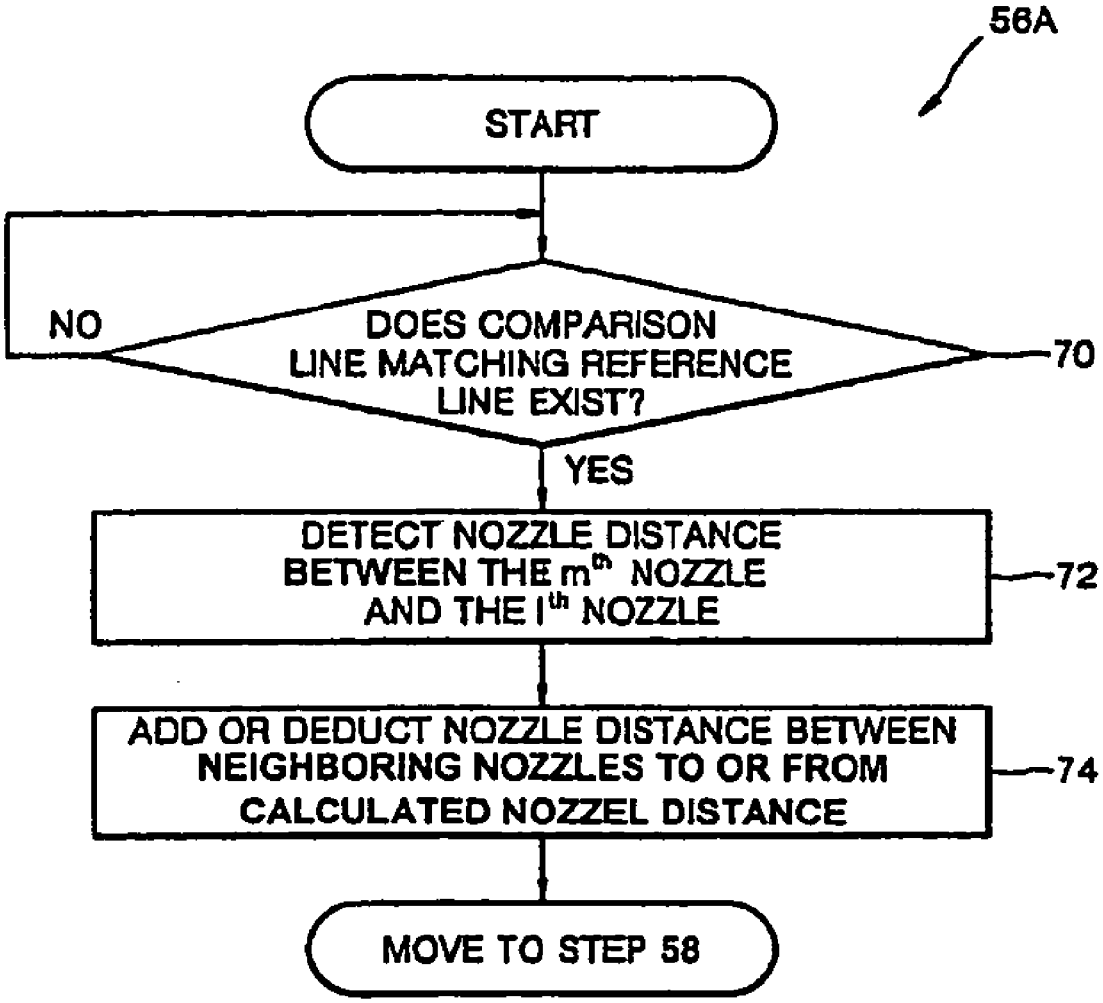
FIG. 7 is a flow chart showing an aspect of the present invention with respect to operation 56 of FIG. 6.

FIG. 7 is a flow chart showing an aspect 56A of the present invention with respect to operation 56 shown in FIG. 6. The aspect comprises: determining whether a predetermined comparison line matching the reference line exists, detecting a nozzle distance; and adding or deducting the nozzle distance between the neighboring nozzles divided by p to or from the detected nozzle distance (operations 70 through 74).

First, it is determined if a predetermined comparison line matching the reference line exists (operation 70). The determination is continuously made until a predetermined comparison line matching the reference line is determined to exist.

If a predetermined comparison line matching the reference line is determined to exist, a nozzle distance between the $l^{th}$ nozzle and the $m^{th}$ nozzle ($N+1 \leqq m \leqq 2N$) that printed the predetermined comparison line matching the reference line is calculated (operation 72). FIGS. 5A and 5B are views illustrating the states in which the reference line and comparison line are printed or the reference point and the comparison point are printed, respectively.

Referring to FIG. 5A, the $m^{th}$ nozzle printing the predetermined comparison line 40 matching the reference line is detected and a distance from the comparison line 42 printed by the $l^{th}$ nozzle disposed at a position corresponding to the $k^{th}$ nozzle is calculated. This distance is a nozzle distance between the $m^{th}$ nozzle and the $l^{th}$ nozzle. When the feed roller actually moves the print paper half the width of the printer head, the $l^{th}$ nozzle and the $m^{th}$ nozzle are the same nozzle. However, as was noted to be a problem in the conventional technology, the feed roller does not accurately move the print paper half the width of the printer head, and a difference is generated between the $l^{th}$ nozzle and the $m^{th}$ nozzle. As shown in FIG. 5A, a nozzle distance D2 between the $l^{th}$ nozzle and the $m^{th}$ nozzle corresponds to a neighboring nozzle distance 2×D1. Referring to FIG. 5B, the $m^{th}$ nozzle printing the comparison point 44 matching the reference point is detected and the distance from the comparison point 46, printed by $1^{th}$ nozzle corresponding to the $k^{th}$ nozzle is calculated as shown in FIG. 5A. As shown in FIG. 5B, the nozzle distance D3 between the $1^{th}$ nozzle and the $m^{th}$ nozzle corresponds to a nozzle distance 2×D1.

After operation 72, the nozzle distance between the neighboring nozzles divided by p is added to or deducted from the calculated nozzle distance and the added/deducted nozzle distance is detected as an error distance (operation 74). For example, the nozzle distance D2 or D3 between the $1^{th}$ nozzle and the $m^{th}$ nozzle is a difference resulting from the movement of the print paper half the width of the printer head±the nozzle distance between the neighboring nozzles divided by p in operation 56. Thus, when in operation 54 the print paper is moved half the width of the printer head±the nozzle distance between the neighboring nozzles divided by p, a value obtained by deducting the nozzle distance between the neighboring nozzles divided by p from the nozzle distance D2 or D3 between the $1^{th}$ nozzle and the $m^{th}$ nozzle is substantially the error distance. Also, when in operation 54 the print paper is moved half the printer head—the nozzle distance between the neighboring nozzles divided by p, a value obtained by adding the nozzle distance between the neighboring nozzles divided by p to the nozzle distance D2 or D3 between the $1^{th}$ nozzle and the $m^{th}$ nozzle is substantially the error distance.

After operation 56, the distance that the print paper moves is corrected according to the detected error distance (operation 58). For example, since an error distance in printing is generated because the print paper is moved too far by the error distance obtained from operation 56, the driving of the feed roller is corrected to move the print paper by distance equal to the error distance less than the width of the printer head.

Figure 8:
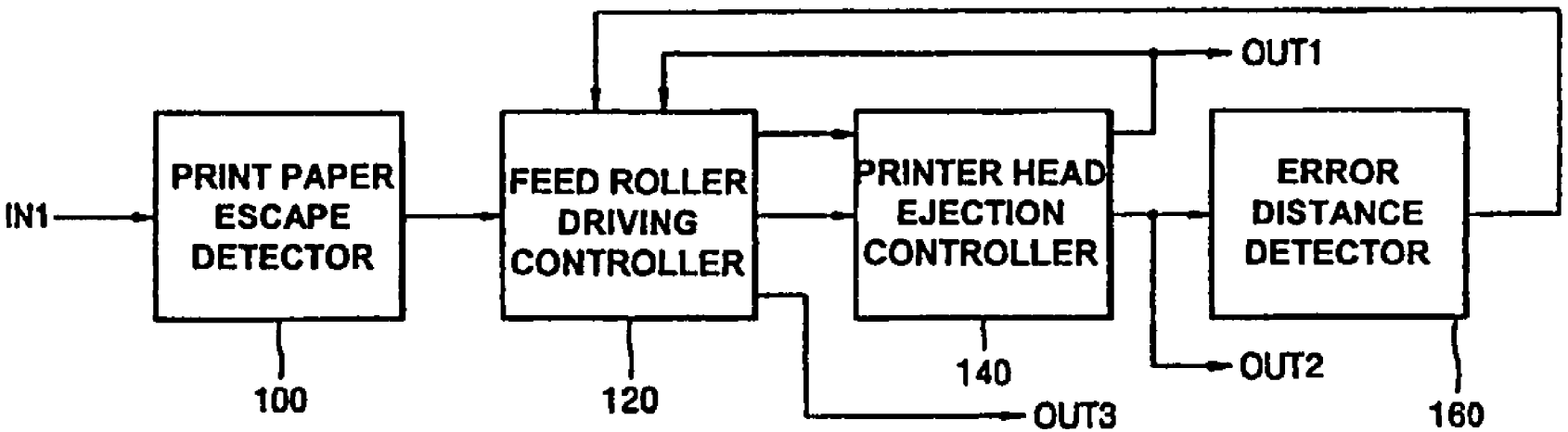
FIG. 8 is a block diagram illustrating an apparatus which corrects a printing error according to an embodiment of the present invention.

FIG. 8 is a block diagram illustrating an apparatus for correcting a print error according to an embodiment of the present invention. Referring to FIG. 8, an apparatus to correct a print error according to an embodiment of the present invention comprises: a print paper escape detector 100; a feed roller driving controller 120; a printer head injection controller 140; and an error distance detector 160.

In operation 10 of FIG. 1, the print paper escape detector 100 detects if the trailing end of the print paper has escaped from the feed roller, which periodically moves the print paper the width of the print head, and outputs the result of the detection as a first control signal. The print paper escape detector 100 receives the result that the trailing end of the print paper has escaped the feed roller from an input point IN1 and, in response thereto, outputs the result that the trailing end of the print paper has escaped the feed roller to the feed roller driving controller 120, as the first control signal.

In operations, 12, 14, and 18, the feed roller driving controller 120 outputs: a second control signal to move the print paper half of the width of the printer head in response to the first control signal; a fourth control signal to again move the print paper half of the width of the printer head in response to a third control signal; and a seventh control signal to move the print paper a corrected distance in response to a sixth control signal.

In response to the first control signal output from the print paper escape detector 100, the feed roller driving controller 120 outputs the second control signal to move the print paper half of the width of the printer head to the printer head ejection controller 140. The printer head width is the width of the $1^{st}$ through $2N^{th}$ nozzles of the printer head, in which N is a positive integer greater than 0. That is, the printer head width is the sum of the distance between the neighboring nozzles. For example, the width of the printer head is a width L between the $1^{st}$ through $2N^{th}$ nozzles provided on the printer head as shown in FIG. 2. The terms width of the printer head and the printer head width may be used interchangeably herein.

In response to the third control signal output from the printer head ejection controller 140, the feed roller driving controller 120 outputs the fourth control signal to move the print paper half of the width of the printer head to the printer head ejection controller 140. The third control signal is a signal to allow the $k^{th}$ nozzle ($1 \leqq k \leqq N$) to print the reference line.

In response to the sixth control signal output from the error distance detector 160, the feed roller driving controller 120 outputs the seventh control signal to move the print paper by a corrected distance through an output port OUT3. The sixth control signal is a signal determined with respect to the error distance detected by the error distance detector 160. When the error distance is D2 or D3, an error distance in printing is generated because the print paper is excessively moved by as much as the error distance D2 or D3. Thus, the feed roller driving controller 120 outputs the seventh control signal to control the driving of the feed roller such that the print paper is moved by a distance equal to the error distance D2 or D3 less than the width of the printer head.

In operations 12 and 14, the printer head ejection controller 140 outputs: the third control signal to print the reference line using the $k^{th}$ nozzle ($1 \leqq k \leqq N$) in response to the second control signal; and the fifth control signal to print the comparison line using the $(N+1)^{th}$ through $2N^{th}$ nozzles in response to the fourth control signal.

In response to the second control signal output from the feed roller driving controller 120, the printer head ejection controller 140 outputs the third control signal to print the reference line using the $k^{th}$ nozzle ($1 \leqq k \leqq N$) through an output port OUT1. The reference line is a line printed along a straight line as a nozzle ejects ink.

In response to the fourth control signal output from the feed roller driving controller 120, the printer head ejection controller 140 outputs the fifth control signal to print the comparison lines using the $(N+1)^{th}$ through $2N^{th}$ nozzles through the output port OUT2. The comparison lines are printed by the $(N+1)^{th}$ through $2N^{th}$ nozzles to detect an error distance by comparing the distance from the above-described reference line. The predetermined interval at which the comparison lines are printed is the same interval as that at which the reference line is printed.

In operation 16, in response to the fifth control signal, the error distance detector 160 detects an error distance between the reference line and the comparison line printed by the $l^{th}$ nozzle ($N+1 \leqq l \leqq 2N$) disposed at a position corresponding to the $k^{th}$ nozzle and outputs the result of the detection as the sixth control signal.

In response to the fifth control signal output from the printer head ejection controller 140, the error distance detector 160 detects an error distance between the reference line and the comparison line printed by the $l^{th}$ nozzle ($N+1 \leqq l \leqq 2N$), disposed at a position corresponding to the $k^{th}$ nozzle among the $(N+1)^{th}$ through $2N^{th}$ nozzles, and outputs the result of the detection to the feed roller driving controller 120 as the sixth control signal. The $l^{th}$ nozzle is disposed among the $(N+1)^{th}$ through $2N^{th}$ nozzles and corresponds to a position identical to the position of the kth nozzle of the $1^{st}$ through the $N^{th}$ nozzles.

Figure 9:
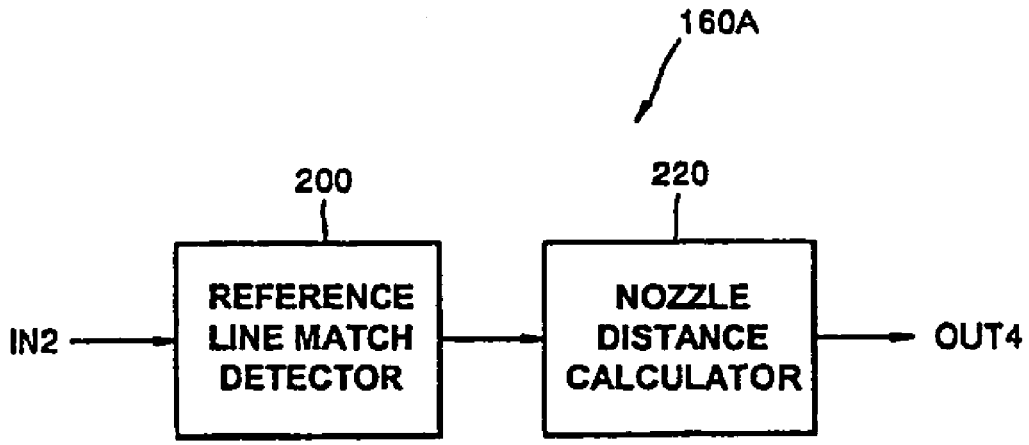
FIG. 9 is a block diagram illustrating an aspect of the present invention with respect to the error distance detector of FIG. 8.

FIG. 9 is a block diagram showing the error distance detector 160 of FIG. 8 according to an aspect 160A of the present invention. The error distance detector 160 includes a reference line match detector 200 and a nozzle distance calculator 220.

In operation 30, the reference line match detector 200 detects if a predetermined comparison line matching the reference line exists and then outputs the result of the detection as the eighth control signal. The predetermined comparison line matching the reference line is a comparison line printed in operation 18 at the same position as the reference line printed in operation 14. In response to the fifth control signal output from the printer head ejection controller 140 through an input port IN2, the reference line detector 200 detects whether a predetermined comparison line matching the reference line exists and outputs the result of the detection to the nozzle distance calculator 220 as the eighth control signal.

In operation 32, in response to the eighth control signal, the nozzle distance calculator 220 calculates a nozzle distance between the $l^{th}$ nozzle and the $m^{th}$ nozzle ($N+1 \leqq m \leqq 2N$), the $m^{th}$ nozzle having printed the comparison line matching the reference line, and outputs the calculated nozzle distance indicating an error distance as the ninth control signal. In response to the eighth control signal output from the reference line match detector 200, the nozzle distance calculator 220 calculates a nozzle distance between the $l^{th}$ nozzle and the $m^{th}$ nozzle ($N+1 \leqq m \leqq 2N$) and outputs the calculated nozzle distance as the ninth control signal through an output port OUT4.

FIGS. 5A and 5B are views illustrating the states in which the reference line and comparison line are printed or the reference point and comparison point are printed, respectively. Referring to FIG. 5A, the $m^{th}$ nozzle prints a predetermined comparison line 40 which is detected as matching the reference line, and a distance from a comparison line 42, printed by the $l^{th}$ nozzle disposed at a position corresponding to the $k^{th}$ nozzle, is calculated. This distance is a nozzle distance between the $m^{th}$ nozzle and the $l^{th}$ nozzle. Thus, as shown in FIG. 5A, the distance between the $l^{th}$ nozzle and the $m^{th}$ nozzle corresponds to 2×D1 which is an error distance D2. Referring to FIG. 5B, the $m^{th}$ nozzle prints the comparison point 44 which is detected as matching the reference point and the distance from the comparison point 46, printed by $l^{th}$ nozzle corresponding to the position of the $k^{th}$ nozzle, is calculated as shown in FIG. 5A. The calculated distance is a nozzle distance D3.

Referring to FIG. 6 in light of FIG. 8, in operation 50 of FIG. 6, the print paper escape detector 100 detects if the trailing end of the print paper has escaped from the feed roller, which periodically moves the print paper the width of the print head, and outputs the result of the detection as a tenth control signal. The print paper escape detector 100 receives the result that the trailing end of the print paper has escaped the feed roller from an input port IN1 and, in response thereto, outputs the result, that the trailing end of the print paper has escaped the feed roller to the feed roller driving controller 120, as the tenth control signal.

In operations, 52, 54, and 58 of FIG. 6, the feed roller driving controller 120 outputs: an eleventh control signal to move the print paper half of the width of the printer head in response to the tenth control signal; a thirteenth control signal to again move the print paper half of the width of the printer head±a nozzle distance between neighboring nozzles divided by p, in which p is a positive integer greater than 0, in response to a twelfth control signal; and a sixteenth control signal to move the print paper by a corrected distance in response to a fifteenth control signal.

In response to the tenth control signal output from the print paper escape detector 100, the feed roller driving controller 120 outputs an eleventh control signal to move the print paper half of the width of the printer head to the printer head ejection controller 140. The width of the printer head is the width of the $1^{st}$ through $2N^{th}$ nozzles provided on the printer head, in which N is a positive integer greater than 0, that is the total of the distance between the neighboring nozzles. For example, the printer head width is a width L between the $1^{st}$ through $2N^{th}$ nozzles provided on the printer head as shown in FIG. 2.

In response to the twelfth control signal output from the printer head ejection controller 140, the feed roller driving controller 120 outputs the thirteenth control signal, to move the print paper half of the width of the printer head±a nozzle distance between neighboring nozzles divided by p, to the printer head ejection controller 140. The twelfth control signal allows the $k^{th}$ nozzle ($1 \leqq k \leqq N$), from among the $1^{st}$ through $N^{th}$ nozzles, to print the reference line.

In response to the fifteenth control signal output from the error distance detector 160, the feed roller driving controller 120 outputs the sixteenth control signal to move the print paper a corrected distance through an output port OUT3. The fifteenth control signal is a signal generated with respect to the error distance detected by the error distance detector 160. An error distance is generated during printings because the print paper is excessively moved by the error distance detected by the error distance detector 160. Thus, the feed roller driving controller 120 outputs the sixteenth control signal to control the driving of the feed roller such that the print paper moves a corrected distance that accounts for the error distance.

In operations 52 and 54, the printer head ejection controller 140 outputs: the twelfth control signal to print the reference line using the $k^{th}$ nozzle, in response to the eleventh control signal; and the fourteenth control signal to print the comparison line using the $(N+1)^{th}$ through $2N^{th}$ nozzles in response to the thirteenth control signal.

In response to the eleventh control signal output from the feed roller driving controller 120, the printer head ejection controller 140 outputs the twelfth control signal to print the reference line using the $k^{th}$ nozzle ($1 \leqq k \leqq N$) through an output port OUT1.

In response to the thirteenth control signal output from the feed roller driving controller 120, the printer head ejection controller 140 outputs the fourteenth control signal to print the comparison lines using the $(N+1)^{th}$ through $2N^{th}$ nozzles through the output port OUT2. The comparison lines are printed by the $(N+1)^{th}$ through $2N^{th}$ nozzles to detect an error distance by comparing the distance from the above-described reference line. The predetermined interval at which the comparison lines are printed is the same as the interval at which the reference line is printed.

In operation 56, in response to the fourteenth control signal, the error distance detector 160 detects an error distance between the reference line and the comparison line printed by the $l^{th}$ nozzle ($N+1 \leqq l \leqq 2N$), disposed at a position corresponding to the $k^{th}$ nozzle among the $(N+1)^{th}$ through $2N^{th}$ nozzles, and outputs the result of the detection as the fifteenth control signal.

In response to the fourteenth control signal output from the printer head ejection controller 140, the error distance detection portion 160 detects an error distance between the reference line and the comparison line printed by the $l^{th}$ nozzle ($N+1 \leqq l \leqq 2N$) and outputs the result of the detection to the feed roller driving controller 120 as the fifteenth control signal. The $l^{th}$ nozzle belonging to the $(N+1)^{th}$ through $2N^{th}$ nozzles is disposed among the $(N+1)^{th}$ through $2N^{th}$ nozzles corresponding to a position identical to the position of the $k^{th}$ nozzle of the $1^{st}$ through the $N^{th}$ nozzles.

Figure 10:
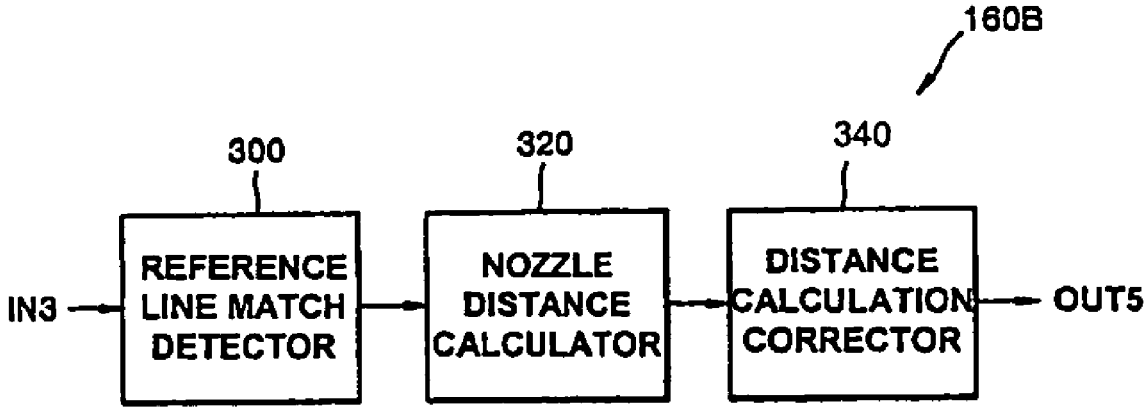
FIG. 10 is a block diagram illustrating another aspect of the present invention with respect to the error distance detector of FIG. 8.

FIG. 10 is a block diagram showing the error distance detector 160 of FIG. 8 according to another aspect 160B of the present invention. The error distance detector 160 comprises a reference line match detector 300, a nozzle distance calculator 320, and a distance calculation corrector 340.

Referring to FIGS. 7 and 10, in operation 70, the reference line match detector 300 detects whether a predetermined comparison line matching the reference line exists, and outputs the result of the detection as the seventeenth control signal. In response to the fourteenth control signal, output from the printer head ejection controller 140 and input through an input port IN2, the reference line detector 300 detects whether a predetermined comparison line matching the reference line exists and outputs the result of the detection to the nozzle distance calculator 320 as the seventeenth control signal.

In operation 72, in response to the seventeenth control signal, the nozzle distance calculator 320 calculates a nozzle distance between the $l^{th}$ nozzle and the $m^{th}$ nozzle ($N+1 \leqq m \leqq 2N$), the $m^{th}$ nozzle having printed a comparison line matching the reference line, and outputs the calculated nozzle distance as the eighteenth control signal. In response to the seventeenth control signal output from the reference line match detector 300, the nozzle distance calculator 320 calculates a nozzle distance between the $l^{th}$ nozzle and the $m^{th}$ nozzle ($N+1 \leqq m \leqq 2N$) and outputs the calculated nozzle distance as the eighteenth control signal to the distance calculation corrector 340.

In operation 74, in response to the eighteenth control signal, the distance calculation corrector 340 adds or deducts the nozzle distance between the neighboring nozzles to or from the calculated nozzle distance and outputs the adjusted calculated nozzle distance as a nineteenth control signal indicating the error distance. The nozzle distance D2 or D3 between the $l^{th}$ nozzle and the $m^{th}$ nozzle as shown in FIGS. 5A and 5B is a difference resulting from the movement of the print paper half of the width of the printer head±a nozzle distance between neighboring nozzles divided by p. For example, when the feed roller driving control portion 120 has the printer paper move half the printer head width+ a nozzle distance between neighboring nozzles divided by p, a value obtained by deducting the nozzle distance between neighboring nozzles divided by p from the nozzle distance D2 or D3 between the $l^{th}$ nozzle and the $m^{th}$ nozzle is the actual error distance. Also, when the feed roller driving controller 120 has the printer paper move half of the width of the printer head—a nozzle distance between neighboring nozzles divided by p, a value obtained by adding the nozzle distance between neighboring nozzles divided by p to the nozzle distance D2 or D3 between the $l^{th}$ nozzle and the $m^{th}$ nozzle is the actual error distance.

In response to the eighteenth control signal output from the nozzle distance calculator 320, the distance calculation corrector 340 adds or deducts the nozzle distance between the neighboring nozzles to or from the calculated nozzle distance and outputs the adjusted calculated nozzle distance as the nineteenth control signal through an output port OUT5.

Figure 11:
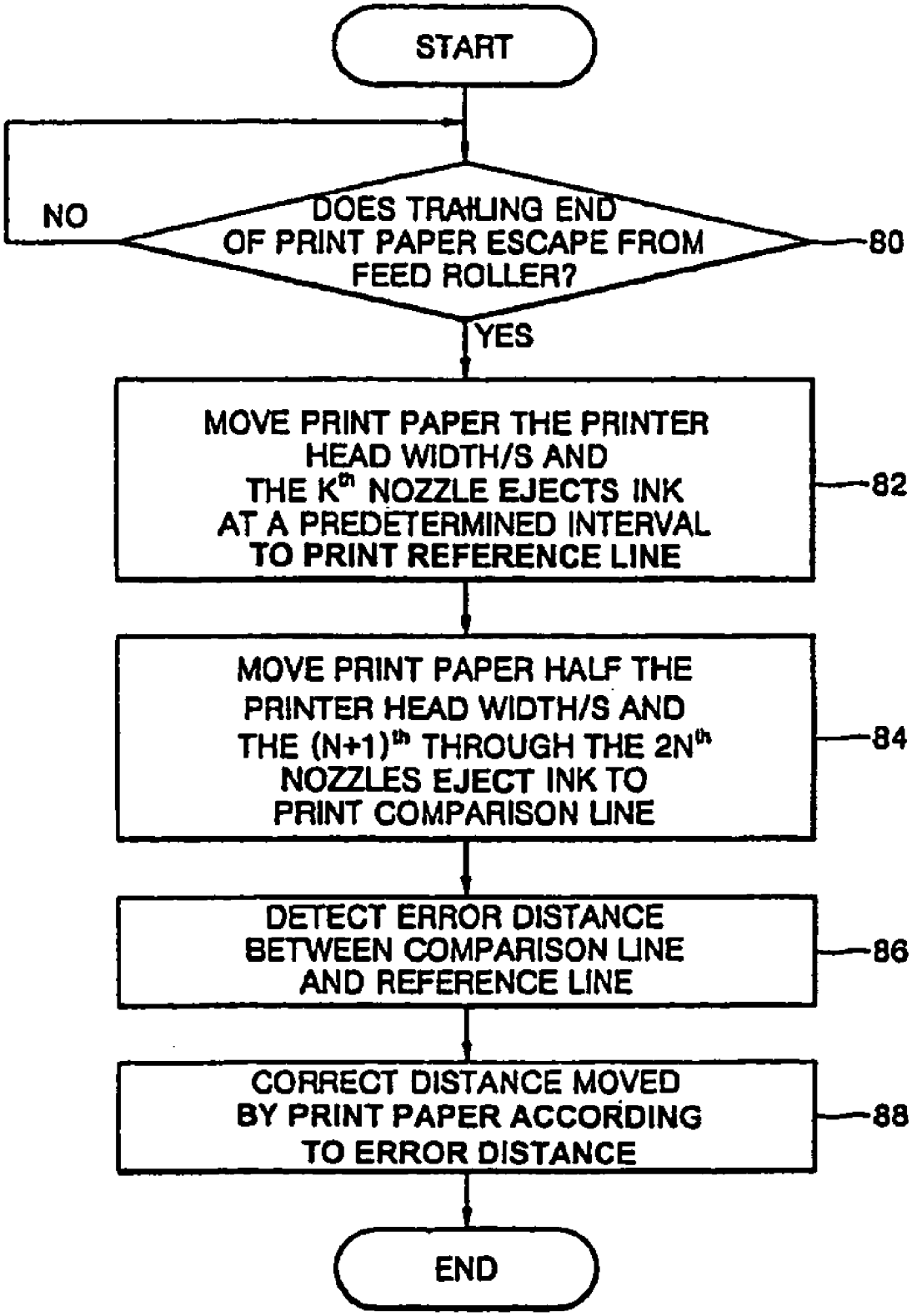
FIG. 11 is a flow chart showing a method of correcting a printing error according to yet another aspect of the present invention.

FIG. 11 is a flow chart for explaining a method of correcting a printing error according to yet another aspect of the present invention. Referring to FIG. 11, the method of correcting a printing error comprises: printing a reference line and comparison lines by moving the print paper escaped from the feed roller the width of the printer head divided by S, in which S is a positive integer greater than 1; and correcting the distance that the print paper moves by detecting an error distance between the printed reference line and the comparison lines (operations 80–88).

First, it is determined if the trailing end of the print paper has escaped from the feed roller that periodically moves the print paper the width of the printer head (operation 80). The determination is continuously made until the trailing end of the print paper is determined to have escaped from the feed roller.

When the trailing end of the print paper is determined to have escaped from the feed roller, the print paper is moved the width of the printer head/S and a reference line is printed by ejecting ink at a predetermined distance using the $k^{th}$ nozzle ($1 \leqq k \leqq N$) (operation 82). Here, the value of the width of the printer head divided by S is set to move the print paper a distance less than the width of the printer head. For example, when S is 3, the print head is moved the width of the printer head divided by 3.

Following operation 82, the print paper on which the reference line is printed is again moved the width of the printer head divided by S and comparison lines are printed by ejecting ink at a predetermined interval using the $(N+1)^{th}$ through $2N^{th}$ nozzles (operation 84).

Following operation 84, an error distance between the reference line and the comparison line printed by the $l^{th}$ nozzle ($N+1 \leqq l \leqq 2N$) disposed at a position corresponding to the $k^{th}$ nozzle is detected (operation 86).

Following operation 86, the distance that the print paper moves is corrected according to the detected error distance (operation 88).

Figure 12:
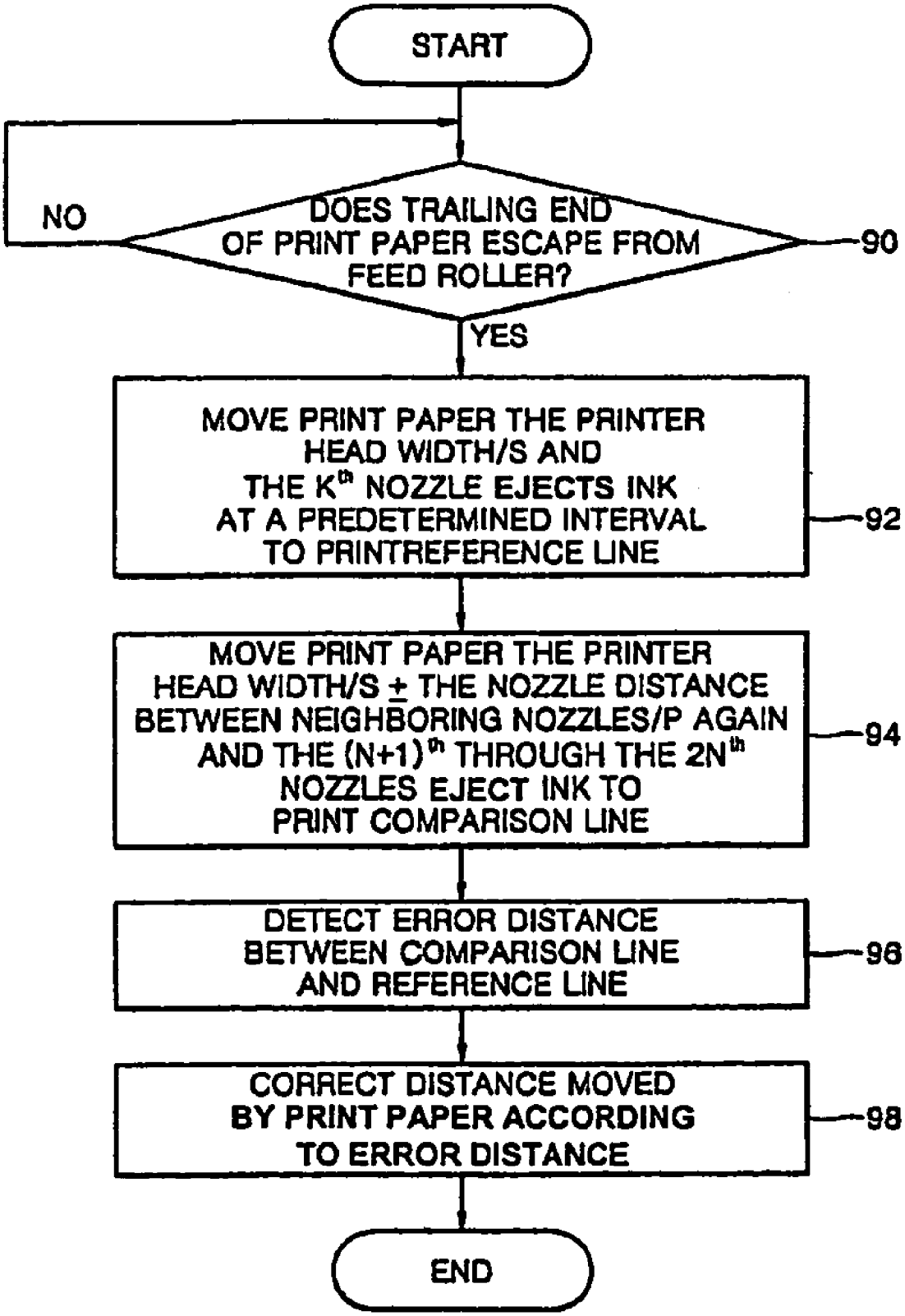
FIG. 12 is a flow chart showing a method of correcting a printing error according to still yet another aspect of the present invention.

FIG. 12 is a flow chart showing a method of correcting a printing error according to still yet another aspect of the present invention. Referring to FIG. 12, the method of correcting a printing error comprises: printing a reference line by moving the print paper escaped from the feed roller the width of the printer head divided by S, in which S is a positive integer greater than 1; printing comparison lines by moving the print paper the width of the printer head divided by S±the nozzle distance between the neighboring nozzles divided by p, in which p is a positive integer greater than 0; and correcting the distance that the print paper moves by detecting the error distance between the printed reference line and the comparison lines (operations 90–98).

First, it is determined whether the trailing end of the print paper has escaped from the feed roller which periodically moves the print paper the width of the printer head (operation 90).

When the trailing end of the print paper is determined to have escaped from the feed roller, the print paper is moved the width of the printer head divided by S and a reference line is printed by ejecting ink at a predetermined interval using the $k^{th}$ nozzle ($1 \leqq k \leqq N$) disposed above the print paper (operation 92).

Following operation 92, the print paper on which the reference line is printed is again moved the width of the printer head/S±the nozzle distance between the neighboring nozzles/p, in which p is a positive integer greater than 0, and comparison lines are printed by ejecting ink at a predetermined interval using the $(N+1)^{th}$ through $2N^{th}$ nozzles [disposed above the print paper moved by the printer head width/S±the nozzle distance between the neighboring distance/p (operation 94).

Following operation 94, an error distance between the reference line and the comparison lines printed by the $l^{th}$ nozzle ($N+1 \leqq l \leqq 2N$) disposed at a position corresponding to the $k^{th}$ nozzle among the $(N+1)^{th}$ through $2N^{th}$ nozzles is detected (operation 96).

Following operation 96, the distance that the print paper moves is corrected according to the detected error distance (operation 98).

An apparatus for correcting a printing error according to another aspect of the present invention which performs the method shown in FIG. 11 will be described with reference to FIG. 8.

In operation 80, the print paper escape detector 100 detects whether the trailing end of the print paper has escaped from the feed roller, which periodically moves the print paper the width of the printer head, and outputs the result of the detection as a twentieth control signal.

In operations 82, 84, and 88, the feed roller driving controller 120 outputs: a twenty-first control signal to move the print paper the width of the printer head divided by S in response to the twentieth control signal; a twenty-third control signal to move the print paper the width of the printer head divided by S again in response to a twenty-second control signal; and a twenty-sixth control signal to move the print paper a corrected distance, in response to a twenty-fifth control signal.

In operations 82 and 84, the printer head ejection controller 140 outputs: the twenty-second control signal to print a reference line using the $k^{th}$ nozzle ($1 \leqq k \leqq N$) in response to the twenty-first control signal; and the twenty-fourth control signal to print comparison lines using the $(N+1)^{th}$ through $2N^{th}$ nozzles in response to the twenty-third control signal.

In operation 86, in response to the twenty-fourth control signal, the error distance detector 160 detects an error distance between the reference line and the comparison line printed by the $l^{th}$ nozzle ($N+1 \leqq l \leqq 2N$), disposed at a position corresponding to the $k^{th}$ nozzle among the $(N+1)^{th}$ through $2N^{th}$ nozzles, and outputs the result of the detection as the twenty-fifth control signal.

An apparatus for correcting a printing error according to yet another aspect of the present invention which performs the method shown in FIG. 12 will be described with reference to FIG. 8.

In operation 90, the print paper escape detector 100 detects if the trailing end of the print paper has escaped from the feed roller, which periodically moves the print paper the width of the printer head, and outputs the result of the detection as a twenty-seventh control signal.

In operations 92, 94, and 98, the feed roller driving controller 120 outputs: a twenty-eighth control signal to move the print paper the width of the printer head divided by S in response to the twenty-seventh control signal; a thirtieth control signal to move the print paper the width of the printer head divided by S±the nozzle distance between the neighboring nozzles divided by p, in which p is a positive integer greater than 0, in response to a twenty-ninth control signal, and a thirty-third control signal to move the print paper the corrected distance in response to a thirty-second control signal.

In operations 92 and 94, the printer head ejection controller 140 outputs: the twenty-ninth control signal to print a reference line using the $k^{th}$ nozzle ($1 \leqq k \leqq N$) in response to the twenty-eighth control signal; and the thirty-first control signal to print comparison lines using the $(N+1)^{th}$ through $2N^{th}$ nozzles in response to the twenty-third control signal.

In operation 96, in response to the thirty-first control signal, the error distance detection portion 160 detects an error distance between the reference line and the comparison line printed by the $l^{th}$ nozzle ($N+1 \leqq l \leqq 2N$) disposed at a position corresponding to the $k^{th}$ nozzle, which is among the $(N+1)^{th}$ through $2N^{th}$ nozzles, and outputs the result of the detection as the thirty-second control signal.

As described above, in the methods and apparatuses for correcting a printing error according to the present invention, to prevent the deterioration of print quality as the print paper moves a regulated distance more or less than desired when the trailing end of the print paper escapes from the feed roller, the distance that the print paper is moved by the feed roller is appropriately corrected.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of correcting a printing error in an inkjet printer having a printer head on which a $1^{st}$ through $2N^{th}$ nozzles are provided, in which N is a positive integer greater than 0, and a feed roller, the method comprising:

determining if a trailing end of a print paper has escaped from the feed roller which periodically moves the print paper a width of the printer head;

if the trailing end of the print paper is determined to have escaped from the feed roller, moving the print paper half the width of the printer head width, and printing a reference line at a predetermined interval using a $k^{th}$ nozzle ($1 \leqq k \leqq N$) from among the $1^{st}$ through $N^{th}$ nozzles;

moving the print paper on which the reference line is printed half the width of the printer head, and printing comparison lines at a predetermined interval using the $(N+1)^{th}$ through $2N^{th}$ nozzles;

detecting an error distance between the reference line and one of the comparison lines printed by an $I^{th}$ nozzle ($N+1 \leqq I \leqq 2N$), the $l^{th}$ nozzle being disposed at a position corresponding to the $k^{th}$ nozzle among the (N+1)th through $2N^{th}$ nozzles; and correcting a distance that the print paper is moved according to the detected error distance.

2. The method as claimed in claim 1, wherein the $1^{st}$ though $N^{th}$ nozzles are disposed above the print paper.

3. The method as claimed in claim 1, wherein the reference line is printed by ejecting ink onto the print paper.

4. The method as claimed in claim 1, wherein the correcting the distance that the print paper is moved comprises moving the print paper by a distance less than the width of the printer head.

5. The method as claimed in claim 4, wherein the distance less than the width of the printer head is the error distance.

6. The method as claimed in claim 1, wherein the detecting an error distance comprises:

determining if one of the comparison lines is a comparison line matching the reference line; and if determined that one of the comparison lines is a comparison line matching the reference line, calculating a nozzle distance between the $l^{th}$ nozzle and the $m^{th}$ nozzle ($N+1 \leqq m \leqq 2N$), the $m^{th}$ nozzle having printed the comparison line matching the reference line, and detecting the calculated nozzle distance as the error distance.

7. A method of correcting a printing error in an inkjet printer having a printer head on which a $1^{st}$ through $2N^{th}$ nozzles are provided, in which N is a positive integer greater than 0, and a feed roller, the method comprising:

determining if a trailing end of a print paper has escaped from the feed roller which periodically moves the print paper a width of the printer head;

if the trailing end of the print paper is determined to have escaped from the feed roller, moving the print paper half the width of the printer head, and printing a reference line at a predetermined interval using a $k^{th}$ nozzle ($1 \leqq k \leqq N$) from among the $1^{st}$ though $N^{th}$ nozzles;

moving the print paper on which the reference line is printed as much as half the width of the printer head±a nozzle distance between neighboring nozzles divided by p, in which p is a positive integer greater than 0, and printing comparison lines at a predetermined interval using the $(N+1)^{th}$ through $2N^{th}$ nozzles;

detecting an error distance between the reference line and one of the comparison lines printed by the $l^{th}$ nozzle ($N+1 \leqq l \leqq 2N$), the $l^{th}$ nozzle being disposed at a position corresponding to the $k^{th}$ nozzle among the $(N+1)^{th}$ through $2N^{th}$ nozzles; and correcting a distance that the print paper is moved according to the detected error distance.

8. The method as claimed in claim 7, wherein the $1^{st}$ though $N^{th}$ nozzles are disposed above the print paper.

9. The method as claimed in claim 7, wherein the reference line is printed by ejecting ink onto the print paper.

10. The method as claimed in claim 7, wherein the correcting the distance that the print paper is moved comprises moving the print paper by a distance less than the width of the printer head.

11. The method as claimed in claim 10, wherein the distance less than the width of the printer head is the error distance.

12. The method as claimed in claim 7, wherein the detecting an error distance comprises:

determining if one of the comparison lines is a comparison line matching the reference line;

if determined that the one of the comparison lines is a comparison line matching the reference line, calculating a nozzle distance between the $l^{th}$ nozzle and the $m^{th}$ nozzle ($N+1 \leqq m \leqq 2N$), the $m^{th}$ nozzle having printed the comparison line matching the reference line; and adding or deducting the nozzle distance between neighboring nozzles/p to or from the calculated nozzle distance, and detecting the added or deducted nozzle distance as the error distance.

13. An apparatus for correcting a printing error in an inkjet printer having a printer head on which a $1^{st}$ through $2N^{th}$ nozzles are provided, in which N is a positive integer greater than 0, and a feed roller, the apparatus comprising:

a print paper escape detector which detects whether a trailing end of a print paper has escaped from the feed roller which periodically moves the print paper a width of the printer head, and outputs the result of the detection as a first control signal;

a feed roller driving controller which outputs a second control signal to move the print paper half the width of the printer head in response to the first control signal, a fourth control signal to move the print paper half the width of the printer head in response to a third control signal, and a seventh control signal to move the print paper by a corrected distance in response to a sixth control signal;

a printer head ejection controller which outputs the third control signal to print a reference line using a $k^{th}$ nozzle ($1 \leqq k \leqq N$) from among the $1^{st}$ through $N^{th}$ nozzles in response to the second control signal, and a fifth control signal to print comparison lines using the $(N+1)^{th}$ through $2N^{th}$ nozzles in response to the fourth control signal; and an error distance detector which detects an error distance between the reference line and a one of the comparison lines printed by the $l^{th}$ nozzle ($N+1 \leqq l \leqq 2N$), the $l^{th}$ nozzle being disposed at a position corresponding to the $k^{th}$ nozzle from among the $(N+1)^{th}$ through $2N^{th}$ nozzles, in response to the fifth control signal, and outputs the result of the detection as the sixth control signal.

14. The method as claimed in claim 13, wherein the $1^{st}$ though $N^{th}$ nozzles are disposed above the print paper.

15. The method as claimed in claim 13, wherein the reference line is printed by ejecting ink onto the print paper.

16. The method as claimed in claim 13, wherein the correcting the distance that the print paper is moved comprises moving the print paper by a distance less than the width of the printer head.

17. The method as claimed in claim 16, wherein the distance less than the width of the printer head is the error distance.

18. The apparatus as claimed in claim 13, wherein the error distance detector comprises:

a reference line match detector which detects if one of the comparison lines is a comparison line matching the reference line, and outputs the result of the detection as an eighth control signal; and a nozzle distance calculator which calculates a nozzle distance between the $l^{th}$ nozzle and the $m^{th}$ nozzle ($N+1 \leqq m \leqq 2N$), the $m^{th}$ nozzle having printed the comparison line matching the reference line, in response to the eighth control signal, and outputs the calculated nozzle distance as a ninth control signal indicating the error distance.

19. An apparatus for correcting a printing error in an inkjet printer having a printer head on which a $1^{st}$ through $2N^{th}$ nozzles are provided, in which N is a positive integer greater than 0, and a feed roller, the apparatus comprising:

a print paper escape detector which detects whether a trailing end of a print paper has escaped from the feed roller which periodically moves the print paper a width of the printer head, and outputs the result of the detection as a tenth control signal;

a feed roller driving controller which outputs an eleventh control signal to move the print paper half the width of the printer head in response to the tenth control signal, a thirteenth control signal to move the print paper half the width of the printer head±a nozzle distance between neighboring nozzles divided by p, in which p is a positive integer greater than 0, in response to a twelfth control signal, and a sixteenth control signal to move the print paper by a corrected distance in response to a fifteenth control signal;

a printer head ejection controller which outputs the twelfth control signal to print a reference line using a $k^{th}$ nozzle ($1 \leqq k \leqq N$) from among the $1^{st}$ through $N^{th}$ nozzles in response to the eleventh control signal, and a fourteenth control signal to print comparison lines using the $(N+1)^{th}$ through $2N^{th}$ nozzles in response to the thirteenth control signal; and an error distance detector which detects an error distance between the reference line and one of the comparison lines printed by the $l^{th}$ nozzle ($N+1 \leqq l \leqq 2N$), the $l^{th}$ nozzle being disposed at a position corresponding to the $k^{th}$ nozzle among the $(N+1)^{th}$ through $2N^{th}$ nozzles, in response to the fourteenth control signal, and outputs the result of the detection as the fifteenth control signal.

20. The apparatus as claimed in claim 19, wherein the error distance detector comprises:

a reference line match detector which detects if a one of the comparison lines is a comparison line matching the reference line, and outputs the result of the detection as a seventeenth control signal;

a nozzle distance calculator which calculates a nozzle distance between the $l^{th}$ nozzle and the $m^{th}$ nozzle ($N+1 \leqq m \leqq 2N$), the mth nozzle having printed the one of the comparison lines matching the reference line in response to the seventeenth control signal, and outputs the calculated nozzle distance as an eighteenth control signal; and a distance calculation corrector which adds or deducts the nozzle distance between the neighboring nozzles divided by p to or from the calculated nozzle distance, and outputs the added or deducted nozzle distance as a nineteenth control signal indicating the error distance.

21. A method of correcting a printing error in an inkjet printer having a printer head on which a $1^{st}$ through $(S \times N)^{th}$ nozzles are provided, in which N and S are positive integers greater than 1, and a feed roller, the method comprising:

determining whether a trailing end of a print paper has escaped from the feed roller which periodically moves the print paper a width of the printer head;

if the trailing end of the print paper is determined to have escaped from the feed roller, moving the print paper the width of the printer head divided by S, and printing a reference line at a predetermined interval using a $k^{th}$ nozzle ($1 \leqq k \leqq N$) from among the $1^{st}$ though $N^{th}$ nozzles;

moving the print paper on which the reference line is printed the width of the printer head divided by S, and printing comparison lines at a predetermined interval using the $(N+1)^{th}$ through $2N^{th}$ nozzles;

detecting an error distance between the reference line and a one of the comparison line printed by the $l^{th}$ nozzle ($N+1 \leqq l \leqq 2N$), the $l^{th}$ nozzle being disposed at a position corresponding to the $k^{th}$ nozzle among the $(N+1)^{th}$ through $2N^{th}$ nozzles; and correcting a distance that the print paper is moved according to the detected error distance.

22. The method as claimed in claim 21, wherein the $1^{st}$ though $N^{th}$ nozzles are disposed above the print paper.

23. The method as claimed in claim 21, wherein the reference line is printed by ejecting ink onto the print paper.

24. The method as claimed in claim 21, wherein the correcting the distance that the print paper is moved comprises moving the print paper by a distance less than the width of the printer head.

25. The method as claimed in claim 24, wherein the distance less than the width of the printer head is the error distance.

26. A method of correcting a printing error in an inkjet printer having a printer head on which a $1^{st}$ through $(S \times N)^{th}$ nozzles are provided, in which N and S are positive integers greater than 1, and a feed roller, the method comprising:

determining whether a trailing end of a print paper has escaped from the feed roller which periodically moves the print paper a width of the printer head;

if the trailing end of the print paper is determined to have escaped from the feed roller, moving the print paper the width of the printer head divided by S, and printing a reference line at a predetermined interval using a $k^{th}$ nozzle ($1 \leqq k \leqq N$) from among the $1^{st}$ though $N^{th}$ nozzles;

moving the print paper on which the reference line is printed as the width of the printer head divided by S±the nozzle distance between neighboring nozzles divided by p, in which p is a positive integer greater than 0, and printing comparison lines at a predetermined interval using the $(N+1)^{th}$ through $2N^{th}$ nozzles;

detecting an error distance between the reference line and one of the comparison lines printed by the $l^{th}$ nozzle ($N+1 \leqq l \leqq 2N$), the $l^{th}$ nozzle being disposed at a position corresponding to the $k^{th}$ nozzle among the $(N+1)^{th}$ through $2N^{th}$ nozzles; and correcting a distance that the print paper is moved according to the detected error distance.

27. The method as claimed in claim 26, wherein the $1^{st}$ though $N^{th}$ nozzles are disposed above the print paper.

28. The method as claimed in claim 26, wherein the reference line is printed by ejecting ink onto the print paper.

29. The method as claimed in claim 26, wherein the correcting the distance that the print paper is moved comprises moving the print paper by a distance less than the width of the printer head.

30. The method as claimed in claim 29, wherein the distance less than the width of the printer head is the error distance.

31. An apparatus for correcting a printing error in an inkjet printer having a printer head on which a $1^{st}$ through $(S \times N)^{th}$ nozzles are provided, in which N and S are positive integers greater than 1, and a feed roller, the apparatus comprising:

a print paper escape detector which detects whether a trailing end of a print paper has escaped from the feed roller which periodically moves the print paper a width of the printer head and outputs the result of the detection as a twentieth control signal;

a feed roller driving controller which outputs a twenty-first control signal to move the print paper the width of the printer head divided by S in response to the twentieth control signal, a twenty-third control signal to move the print paper the width of the printer head divided by S in response to a twenty-second control signal, and a twenty-sixth control signal to move the print paper a corrected distance in response to a twenty-fifth control signal;

a printer head ejection controller which outputs the twenty-second control signal to print a reference line using a $k^{th}$ nozzle ($1 \leqq k \leqq N$) from among the $1^{st}$ through $N^{th}$ nozzles in response to the twenty-first control signal, and a twenty-fourth control signal to print comparison lines using the $(N+1)^{th}$ through $2N^{th}$ nozzles in response to the twenty-third control signal; and an error distance detector which detects an error distance between the reference line and one of the comparison lines printed by the $l^{th}$ nozzle ($N+1 \leqq l \leqq 2N$), the $l^{th}$ nozzle being disposed at a position corresponding to the $k^{th}$ nozzle among the $(N+1)^{th}$ through $2N^{th}$ nozzles, in response to the twenty-fourth control signal, and outputs the result of the detection as the twenty-fifth control signal.

32. An apparatus for correcting a printing error in an inkjet printer having a printer head on which a $1^{st}$ through $(S\times N)^{th}$ nozzles are provided, in which N and S are positive integers greater than 1, and a feed roller, the apparatus comprising:

a print paper escape detector which detects if a trailing end of a print paper has escaped from the feed roller which periodically moves the print paper a width of the printer head, and outputs the result of the detection as a twenty-seventh control signal;

a feed roller driving controller which outputs a twenty-eighth control signal to move the print paper as the width of the printer head divided by S in response to the twenty-seventh control signal, a thirtieth control signal to move the print paper the width of the printer head divided by S±the nozzle distance between neighboring nozzles divided by p, in which p is a positive integer greater than 0, in response to a twenty-ninth control signal, and a thirty-third control signal to move the print paper a corrected distance in response to a thirty-second control signal;

a printer head ejection controller which outputs the twenty-ninth control signal to print a reference line using a $k^{th}$ nozzle ($1\leqq k\leqq N$) from among the $1^{st}$ through $N^{th}$ nozzles in response to the twenty-eighth control signal, and a thirty-first control signal to print comparison lines using the $(N+1)^{th}$ through $2N^{th}$ nozzles in response to the thirtieth control signal; and an error distance detector which detects an error distance between the reference line and one of the comparison lines printed by the $l^{th}$ nozzle ($N+1\leqq l\leqq 2N$), the $l^{th}$ nozzle being disposed at a position corresponding to the $k^{th}$ nozzle among the $(N+1)^{th}$ through $2N^{th}$ nozzles, in response to the thirty-first control signal, and outputs the result of the detection as the thirty-second control signal.

33. A method of correcting a printing error in an inkjet printer having a printer head, on which nozzles are provided, and a feed roller, the method comprising:

determining if a trailing end of a print paper has escaped from the feed roller which periodically moves the print paper;

if the trailing end of the print paper is determined to have escaped from the feed roller, moving the print paper a first distance, and printing a reference line at a predetermined interval;

moving the print paper on which the reference line is printed a second distance, and printing comparison lines at a predetermined interval;

detecting an error distance between the reference line and one of the comparison lines; and correcting a distance that the print paper is moved according to the detected error distance, wherein the first distance is a percentage of the width of the printer head, and wherein the first distance is half the width of the printer head.

34. The method as claimed in claim 33, wherein the second distance is equal to the first distance.

35. The method as claimed in claim 33, wherein an exhaust roller moves the print paper, on which the reference line is printed, the second distance.

36. A method of correcting a printing error in an inkjet printer having a printer head, on which nozzles are provided, and a feed roller, the method comprising:

determining if a trailing end of a print paper has escaped from the feed roller which periodically moves the print paper;

if the trailing end of the print paper is determined to have escaped from the feed roller, moving the print paper a first distance, and printing a reference line at a predetermined interval;

moving the print paper on which the reference line is printed a second distance, and printing comparison lines at a predetermined interval;

detecting an error distance between the reference line and one of the comparison lines; and correcting a distance that the print paper is moved according to the detected error distance, wherein the second distance is equal to the first distance the distance between neighboring nozzles divided by an integer p.

37. An apparatus for correcting a printing error in an inkjet printer having a printer head, on which nozzles are provided, and a feed roller, the apparatus comprising:

a print paper escape detector which detects whether a trailing end of a print paper has escaped from the feed roller which periodically moves the print paper, and outputs the result of the detection as a first control signal;

a feed roller driving controller which outputs a second control signal to move the print paper in response to the first control signal, a fourth control signal to move the print paper in response to a third control signal, and a seventh control signal to move the print paper by a corrected distance in response to a sixth control signal;

a printer head ejection controller which outputs the third control signal to print a reference line in response to the second control signal, and a fifth control signal to print comparison lines in response to the fourth control signal; and an error distance detector which detects an error distance between the reference line and one of the comparison lines in response to the fifth control signal, and outputs the result of the detection as the sixth control signal; and a distance calculation corrector which adds or deducts the nozzle distance between neighboring nozzles divided by a positive integer p to or from the calculated nozzle distance, and outputs the added or deducted nozzle distance as a tenth control signal indicating the error distance.

38. The apparatus of claim 37, further comprising an exhaust roller to move the print paper if a trailing end of a print paper has escaped from the feed roller.

39. The apparatus of claim 37, wherein the error distance detector comprises:

a reference line match detector which detects if a one of the comparison lines is a comparison line matching the reference line, and outputs the result of the detection as an eighth control signal; and a nozzle distance calculator which calculates a nozzle distance between the nozzle that printed the reference line and the nozzle that printed the comparison line matching the reference line, in response to the eighth control signal, and outputs the calculated nozzle distance as an ninth control signal.

40. The apparatus of claim 39, wherein the ninth control signal indicates the error distance.

* * * * *

UNITED STATES PATENT AND TRADEMARK OFFICE

CERTIFICATE OF CORRECTION

PATENT NO. : 7,222,931 B2
APPLICATION NO. : 10/758128
DATED : May 29, 2007
INVENTOR(S) : Yong-duk Lee It is certified that error appears in the above-identified patent and that said Letters Patent is hereby corrected as shown below:

Column 14, Line 43, change "(N+1)th" to --$(N+l)^{th}$--.

Column 15, Line 21, change "by the" to --by an--.

Column 15, Line 44, change "and the" to --and an--.

Column 16, Line 10, change "by the" to --by an--.

Column 16, Line 34, change "and the" to --and an--.

Column 17, Line 1, change "by the" to --by an--.

Column 17, Line 13, change "and the" to --and an--.

Column 17, Line 14, change "mth" to --$m^{th}$--.

Column 17, Line 42, change "by the" to --by an--.

Column 18, Line 12, change "by the" to --by an--.

Column 18, Line 58, change "by the" to --by an--.

Column 19, Line 29, change "by the" to --by an--.

Column 20, Line 12, after "first distance" insert ---±--.

UNITED STATES PATENT AND TRADEMARK OFFICE

CERTIFICATE OF CORRECTION

PATENT NO. : 7,222,931 B2
APPLICATION NO. : 10/758128
DATED : May 29, 2007
INVENTOR(S) : Yong-duk Lee It is certified that error appears in the above-identified patent and that said Letters Patent is hereby corrected as shown below:

Column 20, Line 53, after “signal;” delete “and”.

Signed and Sealed this

Thirtieth Day of October, 2007

JON W. DUDAS
*Director of the United States Patent and Trademark Office*